United States Patent [19]

Fagen, Jr. et al.

[11] 4,357,901

[45] Nov. 9, 1982

[54] METHOD AND SYSTEM FOR MAGNETICALLY SENSING AND CONTROLLING TONER CONCENTRATION AND OPTICAL DENSITY OF COPIES IN ELECTROSTATIC REPRODUCTION

[75] Inventors: Ben W. Fagen, Jr.; Dale B. Parks, both of Rochester, N.Y.

[73] Assignee: Bunnington Corporation, Rochester, N.Y.

[21] Appl. No.: 299,252

[22] Filed: Sep. 3, 1981

[51] Int. Cl.[3] ..... G03G 21/00

[52] U.S. Cl. ..... 118/689; 118/690; 118/657; 430/122; 430/126; 430/903; 355/3 DR; 222/56; 324/219; 324/230

[58] Field of Search ..... 430/122; 118/689, 690, 118/657; 222/56; 355/3 DR; 324/219, 230

[56] References Cited

U.S. PATENT DOCUMENTS

| | | | |
|---|---|---|---|
| 3,376,853 | 4/1968 | Weiler et al. | 118/637 |
| 3,572,551 | 3/1971 | Gillespie et al. | 222/56 |
| 3,587,521 | 6/1971 | Rubenstein | 118/7 |
| 3,674,353 | 7/1974 | Trachtenburg | 355/3 |
| 3,679,099 | 7/1972 | Bullock et al. | 222/55 |
| 3,788,739 | 1/1974 | Coriale | 355/17 |
| 3,802,381 | 4/1974 | O'Neill et al. | 118/7 |
| 3,892,672 | 7/1975 | Gawron | 118/689 |
| 3,893,408 | 7/1975 | Lamel | 118/7 |
| 3,911,861 | 10/1975 | Griesmer | 118/7 |
| 3,932,034 | 1/1976 | Takahashi | 355/3 DD |
| 3,970,036 | 7/1976 | Baer et al. | 118/689 |
| 4,054,230 | 10/1977 | Suzuki et al. | 118/689 |
| 4,088,092 | 5/1978 | Noguchi | 118/689 |
| 4,112,867 | 9/1978 | Suzuki et al. | 118/689 |
| 4,122,459 | 10/1978 | Schloemann | 346/140 R |
| 4,195,260 | 3/1980 | Sakamoto et al. | 324/204 |
| 4,257,348 | 3/1981 | Prohaska | 118/689 |
| 4,270,487 | 6/1981 | Terashima et al. | 118/690 |

*Primary Examiner*—John D. Welsh
*Attorney, Agent, or Firm*—Martin LuKacher

[57] ABSTRACT

A magnetic brush developing system for electrostatic duplication uses a developer having a magnetic carrier and non-magnetic toner which is transferred by the brush to an electrostatic image. A analog signal is derived using a Hall sensor in contact with the brush and adjacent to a magnet of the brush. The location of the sensor after and downstream of the transfer point provides information in the signal both as to the absolute value of the concentration (ratio of toner to carrier by weight) as well as the rate of transfer of the toner to the electrostatic image. These signals are used to control the supplying of replenishment toner to the developer only when the concentration of toner drops below a predetermined desired value and then at a rate commensurate with the rate of transfer of toner to the electrostatic image.

17 Claims, 2 Drawing Figures

Figure 1:
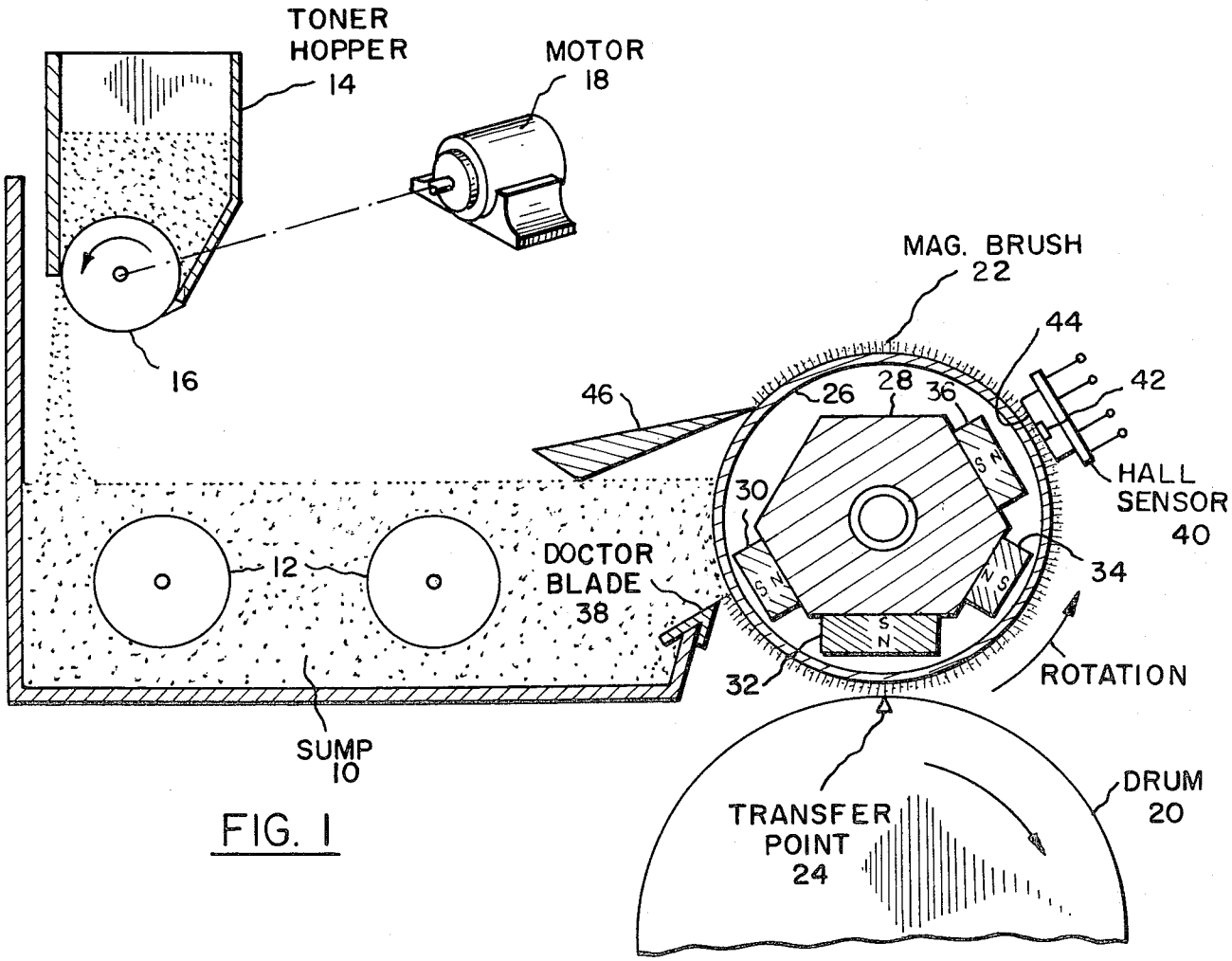

METHOD AND SYSTEM FOR MAGNETICALLY SENSING AND CONTROLLING TONER CONCENTRATION AND OPTICAL DENSITY OF COPIES IN ELECTROSTATIC REPRODUCTION

DESCRIPTION

The present invention relates to methods and apparatus for controlling the concentration of toner in the developer of an electrostatic reproduction system, and particularly to methods and apparatus for maintaining the ratio of toner to carrier particles (concentration) in a dry developer mixture at substantially constant pre-set ratio (e.g. 6% by weight of toner to carrier) so that copies of desirable optical density are obtained by means of electrostatic or xerographic reproduction.

The present invention is especially suitable for use in magnetic brush developer systems for electrostatic copiers or printers and provides features of accurate and precise toner concentration control during the operation of such copiers or printers.

A number of approaches have been suggested for sensing and controlling the toner concentration in a two-component (magnetic carrier and non-magnetic toner powder) developer. These are optical or illumination sensors (see U.S. Pat. No. 3,911,861); developer weight or force sensors (see U.S. Pat. Nos. 3,587,521 and 3,679,099) inductance sensors (see U.S. Pat. Nos. 3,572,551; 3,892,672 3,970,036; 4,088,092; 4,195,260; 4,257,348; and 4,270,487); magnetic permeability sensors (see U.S. Pat. No. 3,802,381); flux density sensors (see U.S. Pat. Nos. 4,054,230 and 4,112,867) and breakdown voltage in the developer sensors (see U.S. Pat. Nos. 3,932,034 and 3,893,408). Other approaches have been to detect the optical density of the toned image on the drum of the electrostatic copier (see U.S. Pat. No. 3,348,522) or the potential of the electrostatic image (see U.S. Pat. Nos. 3,674,353 and 3,788,739) or of the developer itself (see U.S. Pat. No. 3,376,853).

In U.S. Pat. No. 4,112,867 for example, a Hall sensor is used in the fringe field of the magnets in a magnetic brush device at a location prior to the transfer of the toner from the brush to the electrostatic image on the drum. By monitoring the fringe flux through the developer before transfer to the image, only the deviation of toner concentration from a normal concentration can be obtained from the magnetic flux responsive signal produced by the Hall sensor. Hall sensors are also shown in a ribbon inking application (see U.S. Pat. No. 4,122,459).

More accurate and precise control of toner concentration and copies of desired optical density can be obtained if the usage of the toner is sensed and a signal corresponding to usage made available for controlling the supply of replenishment toner. In accordance with the invention, not only is the absolute concentration of the toner in the developer obtained, but also the rate of removal of toner from the developer as toner is transferred to successive images on the drum or other electrostatic image carrier.

Accordingly, it is an object of the present invention to provide an improved method of and system for maintaining the concentration of toner particles in a developer for electrostatic reproduction at a desired concentration of non-magnetic toner particles to magnetic carrier particles.

It is a further object of the present invention to provide an improved method of and system for applying toner with a magnetic brush developer system in electrostatic copiers or printers.

It is a still further object of the present invention to provide an improved method of and system for adding toner at a rate corresponding to the rate of removal from the developer mix rather than at a fixed rate as in prior apparatus for controlling toner concentration.

It is a still further object of the present invention to provide an improved method of and system for maintaining toner concentration in the developer used in an electrostatic copier or printer which is more precise and accurate in controlling toner concentration than prior toner concentration control apparatus.

It is a still further object of the present invention to provide an improved method or system for controlling toner concentration in a developer which may be implemented without extensive modifications to the magnetic brush developer system.

Briefly described, the present invention controls the ratio of a non-magnetic toner to the magnetic carrier of the developer used in electrostatic or xerographic reproduction by deriving a signal, as from a Hall sensor located downstream or after transfer of the toner to the electrostatic image on the drum or other electrostatic image carrier, which signal represents the absolute value of the ratio of toner to carrier and the amount of toner used for each of the images. In response to this signal, the amount of toner is increased (the toner is replenished) whenever the absolute value of the ratio decreases below a predetermined value and at a rate corresponding to the usage of toner; that is the amount of toner used for each of the images.

Figure 2:
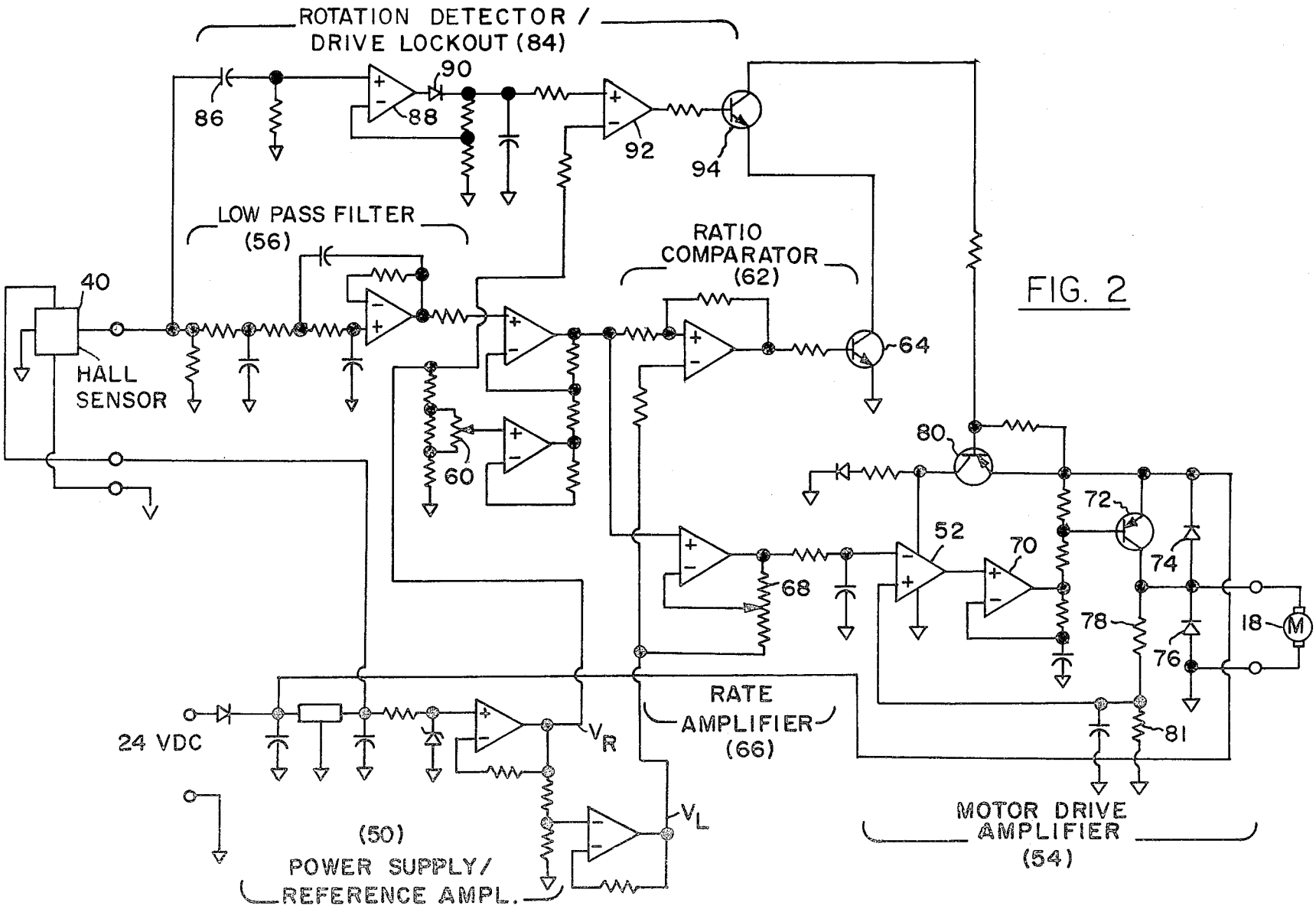

The foregoing objects, features and advantages of the invention as well as a presently preferred embodiment thereof, and the best mode known now for practicing the invention, will become more apparent from a reading of the following description in connection with the accompanying drawings in which:

FIG. 1 is a sectional view schematically illustrating a magnetic brush developer system embodying the invention; and FIG. 2 is a schematic diagram showing the circuitry which is connected to the sensor and toner supply motor, of the system shown in FIG. 1.

Referring more particularly to FIG. 1, there is shown a magnetic brush developer system having a tank or sump 10 filled with developer, which is a mixture of non-magnetic toner and magnetic carrier particles. Mixing devices such as augers 12 in the sump 10 agitate and keep the particles uniformly distributed. Toner particles are supplied to the sump from a toner hopper 14 which is filled with the toner particles. These particles are dispensed through a rotary valve 16 which is turned by a motor 18. The amount of toner supplied from the hopper 14 to the sump 10 depends on the speed of rotation of the motor. The circuitry provided by the invention controls this motor both by turning it on and off and varying the speed of the motor such that a precise amount of toner is dispensed and supplied to the sump 10 so as to maintain the concentration of the toner (the ratio of toner particles to carrier particles by weight) at a predetermined or pre-set ratio, such as 6%.

An electrostatic image carrier such as a drum 20 is partially shown in FIG. 1. The drum 20 contacts a magnetic brush 22 at a transfer point 24 which is shown along a vertical line through the rotating non-magnetic cylinder or tube 26 of the magnetic brush 22. Inside the cylinder 26 and mounted on a stationary support 28 are several permanent magnets 30, 32, 34 and 36. The direction of rotation of the cylinder, and therefore of the magnetic brush of the developer which is formed on the surface of the cylinder, is indicated as being in the counterclockwise direction as viewed in FIG. 1. The drum 20, of course, rotates in the clockwise direction, as shown in FIG. 1.

A brush of desired thickness for transfer to the drum is obtained by means of a doctor blade 38. The developer on the brush travels along the path next reaching the transfer point where, when an electrostatic image is carried on the drum. Some of the non-magnetic toner particles are attracted, thereby depleting the toner and reducing its concentration in the developer.

Downstream of the transfer point and after transfer there is located a Hall sensor device 40. This device comprises a casing having a Hall element 42 therein. The casing is of non-magnetic material such as stainless steel and the front face 44 contacts the magnetic brush and may serve to define a gap in which the magnetic brush is confined between the cylinder 26 and the front face 44 of the casing. The Hall element is on the axis of the magnet 36 and directly in the field of the magnet 36 (not in the fringe field thereof). The Hall sensor element, which may be a commercial device, senses the flux and provides an output in the form of an analog signal which increases in magnitude (amplitude) when the toner concentration in the developer in the brush where contacted by the sensor 40, decreases. Inasmuch as the flux is sensed after transfer the usage or depletion of the toner as each image is toned is represented by the amplitude of the analogue signal, the Hall sensor signal may also be calibrated so as to represent the toner concentration in the sump. Accordingly, both the rate of transfer and the absolute value of the ratio of the toner to carrier (toner concentration) are both present in the Hall sensor signal.

It can be shown that the output signal from the Hall sensor after the calibration is the same as would be obtained from the use of two sensors, one before and the other after the transfer point 24. The location of a sensor before the transfer point is most difficult because of the lack of available space in the developer system. In accordance with the invention, however, two sensors are not needed and one provides the necessary outputs for control of the toner concentration. A scraper blade 46 is disposed adjacent to the cylinder 26 so as to remove the developer and return it to the tank 10.

Referring to FIG. 2 there is shown the Hall sensor 40. A power supply and regulator amplifier 50 operating from a 24 volt DC source provides a bias voltage for the Hall sensor, as well as reference and operating voltages for the rest of the circuitry. The connections from the power supply 50 to the various operational amplifiers, except for an input operational amplifier 52 in the motor drive amplifier 54, are not shown to simplify the illustration.

The polarity of the bias voltage to the Hall sensor is selected so that the analog output voltage from the Hall sensor increases with decreasing flux density. This analog output voltage is applied to a low pass active filter 56 having a cutoff frequency of approximately 0.5 Hz which removes noise and rumble which may be detected due to the moving magnetic brush and drum of the developer system. The filtered analog signal is applied to an offset amplifier 58 which both amplifies (to increase the dynamic range) and applies a DC offset to the analog signal. This offset voltage is obtained from the power supply and reference amplifier 50 as the regulated voltage $V_R$.

In calibrating the system a developer having the desired toner concentration (e.g., 6%) is allowed to thoroughly mix in the sump 10 and run through the system without any electrostatic images being applied to the drum 20. Accordingly, there is no depletion of toner, since there is no usage of the toner during calibration. A potentiometer 60 in the offset amplifier 58 is adjusted so that the DC level of the analog signal is precisely at the point where, when the toner concentration decreases below 6%, an increase in the analog signal is sufficient to switch on a comparator 62. This comparator is called a ratio comparator since it provides an output when the ratio of toner particles to carrier particles is depleted below the pre-set ratio. A reference voltage $V_L$ and the offset voltage obtained through the use of the offset amplifier 58 sets the switching point. The comparator 62 provides a bi-level digital signal to switch a transistor 64 on when the comparator switches to the high level output state. This digital signal is used to enable the motor drive amplifier 54 when the absolute value of the ratio (the toner concentration in the developer) drops below the pre-set value.

In order to obtain from the analog signal which is provided by the Hall sensor 40, the low pass filter 56, and the offset amplifier 58, a signal which varies in accordance with the usage or rate of depletion of the toner, a rate amplifier 66 is used. This is an operational amplifier with a potentiameter 68 in its feedback path which controls its gain and the amplitude of the rate signal which is applied to the input operational amplifier 52 of the motor drive amplifier 54. A comparator amplifier 70, connected as a square wave oscillator whose frequency or duty cycle is voltage controlled, is driven by the input operational amplifier 52. The oscillator 70 controls a transistor 72. The speed of the motor 18 (a DC motor) depends upon the duty cycle of the square wave drive signal applied to the base of the transistor 72. The transistor 72 is protected by commutating diodes 74 and 76 which absorb inductive spikes and maintain current flow through the motor between alternate half cycles of the square wave. A feedback signal corresponding to the motor current is developed across resistors 78 and 80 in the collector emitter path of the power transistor 72. This feedback is to the input operational amplifier 52 for stabilizing the motor speed to correspond directly to the rate amplifier output signal.

Operating voltage for the input operational amplifier 52 and comparator amplifier 70 passes through a switching transistor 80. This operating voltage, when on, illuminates a light-emitting diode (LED) 82. When the LED 82 is illuminated, this is an indication that the toner supply control motor 18 is operating. The switching transistor 80 is switched on by the digital signal 64 which is a high voltage when the toner concentration has diminished below the pre-set concentration (absolute value of the ratio of toner to carrier by weight). Accordingly, the motor 18 can run only when the toner has been depleted. The motor will run at a speed and dispense toner at a rate depending upon the amplitude of the analog signal. Accordingly, precise control and maintenance of toner concentration is obtained.

In order that the toner motor not run while the developer system is shut down and thereby preclude the possibility of improper mixing of the toner with the carrier in the sump 10, a rotation detector and motor drive lockout circuit 84 is provided. The signal from the Hall sensor 40, prior to filtering, contains the noise which is cyclical at the rate of rotation of the brush, the drum and the auger. This signal is AC coupled through a capacitor 86 to an amplifier 88. An output diode 90 provides a DC signal which is filtered and applied to a comparator 92. The comparator produces a digital voltage which turns a switching transistor 94 on when there is sufficient signal to indicate rotation in the developer system of the brush, drum and other parts thereof. When the transistor 94 and the transistor 64 are both switched on, the switching transistor 80 is on and operating power is applied to the input amplifier 52 and comparator amplifier 70 of the motor drive amplifier 54. Accordingly, two conditions are required for the toner supply motor 18 to operate, namely rotation of the developer system and a toner concentration which drops below the pre-set value in absolute terms. The speed of the motor varies in accordance with the amplitude of the analog signal so as to provide precise and accurate supplying and replenishment of the toner.

From the foregoing description it will be apparent that is has been provided an improved method of and apparatus for maintaining toner concentration in a magnetic brush developer system. Variations and modifications of the herein described system and method, within the scope of the invention, will undoubtedly suggest themselves to those skilled in the art. Accordingly, the foregoing description should be taken as illustrative and not in a limiting sense.

We claim:

1. The method for controlling the ratio of the non-magnetic toner to the magnetic carrier of the developer used in electrostatic reproduction of images which comprises the steps of deriving a signal which represents both the absolute value of said ratio and the amount of toner used for each of said images, and replenishing the amount of toner in said developer in response to said signal whenever said absolute value decreases below a predetermined value and at a rate corresponding to said amount.

2. The method according to claim 1 wherein said signal deriving step is carried out by measuring the magnetic flux through said developer after electrostatic transfer thereof to form an image with said toner.

3. The method according to claim 2 including the step of magnetically carrying said developer along a path from a tank containing said developer to a region where said electrostatic transfer takes place and back to said tank, generating magnetic flux at a plurality of points along said path, said measuring step being carried out in the immediate vicinity of one of said points where said flux is generated between the one of said points where electrostatic transfer takes place, and the one of said points where said developer is carried back to said tank.

4. The method according to claim 3 wherein said carrying step includes the step of forming a magnetic brush of said developer which travels along said path, and said measuring step is carried out within said brush.

5. The method according to claim 3 wherein said increasing step is carried out by supplying toner to said tank when said absolute value as indicated by said signal decreases below said predetermined value and at a rate which varies with said amount.

6. The method according to claim 5 wherein said supplying step is carried out with a motor by enabling said motor to operate when said signal decreases below said predetermined value and at a speed which varies with said amount.

7. The method according to claim 6 further comprising the step of detecting when said brush is travelling, and inhibiting the operation of said motor unless said brush is travelling.

8. A system for controlling toner concentration in a developer having a magnetic carrier and a non-magnetic toner which is carried in the form of a magnetic brush and transferred onto an electrostatic image bearing surface which comprises means for deriving a first signal having a magnitude which corresponds to said concentration and which varies in accordance with the amount of said toner transferred to said electrostatic image, and means for supplying toner to said developer when said first signal reaches a magnitude corresponding to said concentration being below a predetermined concentration and at a rate which varies with the magnitude of said signal.

9. The invention as set forth in claim 8 wherein said deriving means includes means responsive to said first signal for providing a second signal when said first signal reaches said predetermined magnitude and a third signal which varies in magnitude with said first signal, said supplying means comprises a motor and means for operating said motor when said second signal is present and at a speed determined by said third signal.

10. The invention as set forth in claim 9 wherein said deriving means comprises means for providing an analog signal as said first signal, said second signal providing means comprises comparator means responsive to said analog signal for providing a digital, bi-level signal as said second signal, and said third signal providing means is an amplifier.

11. The invention as set forth in claim 10 wherein said analog signal providing means comprises offset amplifier means for offsetting said analog signal by a fixed level at which said comparator means switches between its levels when said concentration reaches said predetermined concentration and said toner is not being transferred to said image bearing surface, said offset amplifier means being connected to said comparator and said third signal amplifier.

12. The invention as set forth in claim 10 further comprising a motor drive amplifier system having an input operational amplifier, means for controlling the current to said motor, means for applying operating power to input operational amplifier, said input operational amplifier being coupled to said current controlling means, said third signal amplifier being connected to said input operational amplifier and said digital, bi-level signal being connected to said operating power applying means to turn said input operational amplifier and said motor on and off.

13. The invention as set forth in claim 12 further comprising means responsive to said first signal for providing a fourth signals when said brush is in motion, and means responsive to said fourth signal for controlling with said digital signal said means for applying operating power to said first operational amplifier to prevent operation of said motor when said brush is not in motion.

14. The invention as set forth in claims 8,9,10,11,12 or 13 further comprising Hall effect sensor means for providing said first signal, disposed and contact with said brush at a point downstream and after where said toner is transferred to said image bearing surface.

15. The invention as set forth in claim 14 further comprising low pass filter means for providing an analog signal which corresponds to the magnetic flux at said point.

16. The invention as set forth in claim 14 wherein said magnetic brush is provided by a plurality of permanent magnets within a rotatable non-magnetic tube, said point being disposed adjacent said tube opposite to one of said magnets.

17. The invention as set forth in claim 12 wherein said current controlling means comprises a voltage variable square wave oscillator connected to the output of said input operational amplifier.

* * * * *